US009580941B2

(12) United States Patent
Heberer et al.

(10) Patent No.: US 9,580,941 B2
(45) Date of Patent: Feb. 28, 2017

(54) HANDLE MODULE FOR A MOTOR VEHICLE DOOR

(75) Inventors: Andreas Heberer, Mainz (DE); Winfried Langendorf, Weisbaden (DE); Mark Rosenau, Schornsheim (DE); Peter Eduard Schuessler, Hoesbach (DE); Joerg Gschweng, Mainz (DE); Thorsten Luedtke, Mainz (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 319 days.

(21) Appl. No.: 12/960,233

(22) Filed: Dec. 3, 2010

(65) Prior Publication Data

US 2011/0131764 A1 Jun. 9, 2011

(30) Foreign Application Priority Data

Dec. 3, 2009 (DE) ..... 10 2009 056 921

(51) Int. Cl.

| | |
|---|---|
| ***E05B 3/08*** | (2006.01) |
| ***E05B 85/02*** | (2014.01) |
| ***E05B 77/04*** | (2014.01) |
| ***E05B 79/06*** | (2014.01) |
| *E05B 17/00* | (2006.01) |
| *E05B 85/08* | (2014.01) |

(52) U.S. Cl.

CPC ..... *E05B 85/02* (2013.01); *E05B 77/04* (2013.01); *E05B 79/06* (2013.01); *E05B 17/0062* (2013.01); *E05B 85/08* (2013.01); *Y10T 16/458* (2015.01)

(58) Field of Classification Search

CPC ..... H04M 1/0237; H04M 1/0247

USPC ..... 292/336.3, 216

See application file for complete search history.

(56) References Cited

U.S. PATENT DOCUMENTS

| | | | | |
|---|---|---|---|---|
| 4,005,887 | A * | 2/1977 | Itakura | 292/216 |
| 5,431,462 | A | 7/1995 | Lignell | |
| 6,240,754 | B1 | 6/2001 | Petersen | |
| 8,157,301 | B2 * | 4/2012 | Sunahara et al. | 292/336.3 |

(Continued)

FOREIGN PATENT DOCUMENTS

| | | |
|---|---|---|
| CN | 101240683 A | 8/2008 |
| DE | 19955693 A1 | 5/2001 |

(Continued)

OTHER PUBLICATIONS

British Patent Office, British Search Report for British Application No. 1020340.4, Apr. 4, 2011.

(Continued)

*Primary Examiner* — Kristina Fulton
*Assistant Examiner* — Thomas Neubauer
(74) *Attorney, Agent, or Firm* — Lorenz & Kopf LLP

(57) ABSTRACT

A handle module is provided for fastening an outer door handle to a motor vehicle door with a modular basic body that in a final assembly state with its outer door handle protrudes through an opening in the outer door panel and comes to lie on the inside of the outer door panel. A giver is mounted on the modular basic body in a manner allowing pivoting or turning can be brought in operational connection with a taker of the door lock via an actuation rod. A shielding device is provided that at least partially encloses the giver at least in some regions.

14 Claims, 4 Drawing Sheets

(56) References Cited

U.S. PATENT DOCUMENTS

| | | | | |
|---|---|---|---|---|
| 8,282,142 | B2 | 10/2012 | Fannon | |
| 8,465,064 | B2 * | 6/2013 | Ghannam | 292/336.3 |
| 2004/0251693 | A1 * | 12/2004 | Schoen et al. | 292/1 |
| 2005/0210936 | A1 | 9/2005 | Pantke et al. | |
| 2008/0185850 | A1 * | 8/2008 | Takaya et al. | 292/336.3 |
| 2008/0277948 | A1 * | 11/2008 | Takaya et al. | 292/336.3 |
| 2009/0256366 | A1 * | 10/2009 | Abe | 292/336.3 |
| 2010/0109350 | A1 * | 5/2010 | Gschweng et al. | 292/196 |
| 2010/0127516 | A1 | 5/2010 | Fannon | |
| 2010/0181782 | A1 | 7/2010 | Harrison | |
| 2010/0276949 | A1 * | 11/2010 | Chang et al. | 292/336.3 |

FOREIGN PATENT DOCUMENTS

| | | | | |
|---|---|---|---|---|
| DE | 102009051536 | A1 | 5/2010 | |
| EP | 1950366 | A2 | 7/2008 | |
| GB | 1442394 | A | 7/1976 | |
| GB | 2361675 | * | 4/2000 | E05B 65/12 |
| GB | 2361675 | A | 10/2001 | |
| WO | 8900231 | A1 | 1/1989 | |
| WO | 2008017841 | A1 | 2/2008 | |

OTHER PUBLICATIONS

German Patent Office, German Search Report for German Application No. 102009056921.9, Oct. 11, 2010.

UK IPO, British Examination Report for Application No. 1020340.4, dated Sep. 30, 2013.

State Intellectual Property Office of the People's Republic of China, Office Action in Chinese Patent Application No. 201010560907.5, mailed Feb. 19, 2014.

* cited by examiner

HANDLE MODULE FOR A MOTOR VEHICLE DOOR

CROSS-REFERENCE TO RELATED APPLICATION

This application claims priority to German Patent Application No. 102009056921.9, filed Dec. 3, 2009, which is incorporated herein by reference in its entirety.

TECHNICAL FIELD

The technical field relates to a handle module for fastening an outer door handle to a motor vehicle door and motor vehicle doors and motor vehicles equipped with such a handle module. In addition, the invention relates to an assembly method for a handle module or for a closing device of a motor vehicle door.

BACKGROUND

Almost all doors of motor vehicles, particularly of passenger motor vehicles, are equipped with a closing device comprising at least one door lock arranged within the door structure which interacts with a closing bolt arranged in the door frame correspondingly thereto. There, the lock can be transferred into a release position via at least one actuation lever in which release position the closing bolt is released and the door can be opened.

The actuation lever is typically actuatable via a so-called lock rod, which on the other end is in engagement with a handle module typically arranged approximately at the height of the belt line of the door. Among other things, the handle module serves for the fastening of an outer door handle to be actuated by the user. The handle module is furthermore designed to mechanically redirect the actuation of the door handle initiatable by the user in such a manner that the lock rod can transmit a substantially linear movement to the actuation element at the lock end. Typically, a crank or lever-like giver is provided for this purpose on the handle module, on which the lock rod is pivotably mounted.

If for example the outer door handle is actuated, the handle module transmits that actuation into a corresponding pivot movement of its giver. By means of the lock rod the pivot movement is transmitted to the actuation lever or the taker of the lock, so that in the case of an unlocked closing mechanism the closing bolt is released and the door can be opened.

With a closing device of this type, as is already known in broad outlines from GB 1 442 394 it proves problematic if the vehicle door and/or the lock rod is/are subjected to a mechanical deformation as can typically occur during a vehicle collision or during an attempted break-in in the vehicle. Through the direct or indirect force effect on the lock rod the lock in effect can be transferred into a release position and the vehicle door thus opened. Because of the known weakness, vehicle thieves very gladly make use of elongated and pointed objects such as screwdrivers which they thrust through the outer door panel from the outside below the outer door handle so that the screwdriver brings about a movement or deformation of the lock rod in the sense that said lock rod transfers the actuation lever of the lock into the release position. Other types of break-in attempts are directed at entering the interior region of the door structure from the top, for example via a window shaft opening and, there, manually actuating the lock rod in the desired manner for example by means of a wire or metal hook.

Known locking devices for motor vehicle doors additionally have the disadvantage that during a deformation of the door structure due to a collision they have a tendency to transfer the lock into its release position, so that the door opens and the vehicle occupants can no longer be optimally protected especially in such critical situations.

It is therefore at least one object to make available a closing device for motor vehicle doors which with regard to the occupant protection has improved crash characteristics and greater resistance to forced opening of the vehicle door. It is additionally an object to make available a simplified and more cost-effective assembly concept for a closing device of a motor vehicle door. In addition, other objects, desirable features and characteristics will become apparent from the subsequent summary and detailed description, and the appended claims, taken in conjunction with the accompanying drawings and this background.

SUMMARY

A handle module, a vehicle door, a motor vehicle and a method for the assembly of a closing device are provided in accordance with embodiments. The handle module is provided for the fastening of an outer door handle to a motor vehicle door. The handle module comprises a modular basic body which in a final assembly state in or on the motor vehicle door with its outer door handle protrudes through an opening in the outer door panel. On reaching the final assembly state the actual modular basic body comes to lie on the inside of the outer door panel. This means, it is not visible from the outside and to the user.

Preferentially the modular basic body is arranged on the inside of the outer door panel of the motor vehicle door or the door structure. The outer door handle, which is connected to the modular basic body and operationally connected mechanically to the latter, consequently protrudes from the inside through the door handle opening of the outer door panel. On the inside on the modular basic body a pivotably or rotatably mounted giver is provided, which can be pivoted between a basic and an actuation position by actuating the outer door handle. At the free end of the giver an actuation rod is pivotably arranged, which can be brought into operational connection with a taker of the door lock, typically with an actuation lever of the door lock on reaching a final assembly configuration.

By means of the actuation rod, which can also be called lock rod, an actuation of the outer door handle initiated by a user can thus be translated into an actuation of the actuation lever on the lock end resulting in the release of the lock via the pivot movement of the giver and via the actuation rod articulated thereon.

The handle module has a shielding device enclosing the giver of the modular basic body at least in certain regions. Effectively protecting the connecting region of giver and actuation rod against external manipulations is particularly achieved with the help of the shielding device. Because the shielding device encloses the giver and the actuation rod articulated thereon at least in certain regions, the connecting region compared with known handle modules is better protected against external outside influence. Here, the shielding device substantially acts as sturdy cover or housing in such a manner that the giver of the modular basic body and/or of the upper region of the actuation rod articulated thereon can no longer be manipulated with the usual break-in tools such as screwdrivers or wire hooks.

According to a first embodiment it is provided to connect the shielding device to the modular basic body in a fixed manner. This is an advantage insofar as the shielding device forms a structural unit with the modular basic body even before installation of the handle module in the door and finally is to be mounted in the intended fastening location in the door together with the suitably preconfigured handle module. Here, it proves to be particularly advantageous if the shielding device is unreleasably arranged on the modular basic body. The reciprocal fastening of modular basic body and shielding device can be designed in such a manner that for releasing the shielding device from the modular basic body at least partial destruction of those components is required. Disassembly and specific non-destructive manipulation of the handle module can thus be largely excluded.

According to a further embodiment, the shielding device is designed as a box-shaped cover. Here, it is designed largely open preferentially downwards, i.e., towards the door lock so that the movement of the actuation rod protruding through that lower opening is not affected. In addition, the basic geometry of the shielding device is preferentially adapted to the installation space conditions of the door structure.

According to a further embodiment it is further provided that the shielding device is arranged on a side of the modular basic body facing away from the outer door handle. This means the shielding device is fastened to the modular basic body facing the vehicle interior.

According to a further embodiment it is additionally provided that the shielding device substantially completely contacts the modular basic body over the full area upwards, i.e., in the final assembly state facing a belt line of the door. In this manner the transition region from giver and actuation rod upwards towards the belt line of the door can be protected from outside influence. The shielding device prevents entry of break-in tools into the sensitive transition region of giver and actuation rod, for example from the top through the window shaft.

Advantageously, the shielding device substantially extends over the entire height of the modular basic body extending along the vertical vehicle axis. Depending on its specific geometrical configuration the shielding device can also contribute to the mechanical stability of the modular basic body. Modular basic body as well as shielding device can additionally be produced as an injection-molded or die-cast component, more preferably as a plastic injection molding or metal die-casting.

A further embodiment is achieved in that the actuation rod is designed in at least two parts and with a connecting part is articulated on the giver of the modular basic body. The two-piece configuration of the actuation rod proves advantageously especially under assembly aspects. Thus it can for instance be provided to fasten the connecting part of the actuation rod to the modular basic body or its giver even prior to an assembly of the shielding device. For with a subsequent fastening of the actuation rod to the modular basic body otherwise usual in the prior art the shielding device could be an obstacle to and a disadvantage for the insertion of the actuation rod through its lower opening.

According to a further embodiment the connecting part of the actuation rod can be positively connected to a rod part of the actuation rod which is in engagement with or can subsequently be brought into engagement with the taker of the lock. Here, a bayonet closure-like connection is more preferably provided, wherein the connecting part and the rod part each have positive connection means corresponding to each other.

Thus it can be achieved for instance that the connecting part and the rod part can be positively brought into engagement with each other through reciprocal twisting. If thereafter the two components of the closing device mechanically coupled to each other via the actuation rod, that is the handle module and the lock, are fastened in their assembly positions of the door structure intended for this purpose, twisting of rod part and connecting part can be prevented through the respective connection to the giver and to the taker and thus spontaneous and unintentional dismantling of the actuation rod following completed assembly effectively prevented.

According to a further embodiment it is additionally provided that the connecting part and/or the connection of connecting part and rod part of the actuation rod comprise/s at least one predetermined breaking point or a weakening line acting as predetermined breaking point or a corresponding material weakening. Through the weakening or predetermined breaking point specific breaking apart of the actuation rod and thus an interruption of the mechanical connection of handle module and door lock is to be brought about, especially when the door is subjected to particularly high external forces as can typically occur during a break-in attempt and/or during a vehicle collision. Through the weakening or predetermined breaking point provided in the connecting region of the actuation rod on the giver the actuation rod in this region becomes particularly susceptible to forces acting in vehicle transverse direction. As soon as for example a vehicle thief from the outside thrusts an object into the door structure this should ideally result in a breakage of the predetermined breaking point. This results in that the rod part of the actuation rod falls down and thus it is no longer likely that it can be grasped for opening the door lock through the door or window shaft for example from the top. The lock then remains in its closing position and the door cannot be easily opened.

According to a further embodiment it is additionally provided that on the modular basic body a transmission member of plate-like design extending to the inside towards the actuation rod is arranged, which is designed for bringing about a breakage of the actuation rod should external forces deforming the door occur. The transmission member is preferentially designed L-shaped in cross section, wherein a leg of the L-shaped configuration substantially extends in vehicle transverse direction to the inside, to the actuation rod and towards its predetermined breaking point, while the other leg of the L-shaped configuration preferentially comes to lie between modular basic body and outer door panel. In this manner, a deformation of the outer door panel initiated from the outside can be directly transmitted to the actuation rod in form of a shearing force, following which the actuation rod breaks in the defined manner in the region of its predetermined breaking point or weakening line. As a consequence of this, opening of the vehicle door is prevented. For the effective force transmission the transmission member is preferentially produced of metal, more preferably of steel plate, while the handle module as such is to be preferentially designed as plastic injection molding component to save manufacturing costs and to reduce its component weight.

It is also provided that in addition to preconfiguring the handle module with the shielding device arranged thereon and with a connecting part of the actuation rod already articulated on its giver, to produce this as structural unit for example by an automotive supplier and to arrange and fasten the module preconfigured in this manner subject to establishing a connection with a rod part pivotably articulated on the actuation lever of the lock in the vehicle door.

In accordance with a further embodiment a motor vehicle door equipped with the handle module and a motor vehicle equipped with such a motor vehicle door and thus with such a handle module. A method is also provided for the assembly of a closing device or a handle module on or in a motor vehicle door. Here, the method is characterized by the method steps that initially a previously described handle module with a connecting part already preassembled thereon and enclosed by the shielding device at least in certain regions is provided. After this, the connecting part of the actuation rod is connected to a rod part that is in operational connection with the taker of the door lock and finally the handle module arranged on or in the door structure and fastened thereon.

Here, a connecting part and rod part are to be connected to each other via a positive connection which preferentially can be established through reciprocal twisting of connecting part and rod part, for example connected to a corresponding twisting of door lock and/or handle module during the course of the assembly process. The shielding device serving as cover, the modular basic body and the actuation rod are designed in such a manner that following an assembly in the door structure they can no longer be non-destructively separated from one another. Preferentially, these components should also be seen in the form of a suitably preconfigured module as structural unit which suitably preconfigured are to be arranged and fastened in the door structure with only few manual operations. Alternatively it can also be provided to subsequently assemble the actuation rod on the giver of the handle module and/or on the taker of the door lock.

BRIEF DESCRIPTION OF THE DRAWINGS

The present invention will hereinafter be described in conjunction with the following drawing figures, wherein like numerals denote like elements.

DETAILED DESCRIPTION

Figure 1:
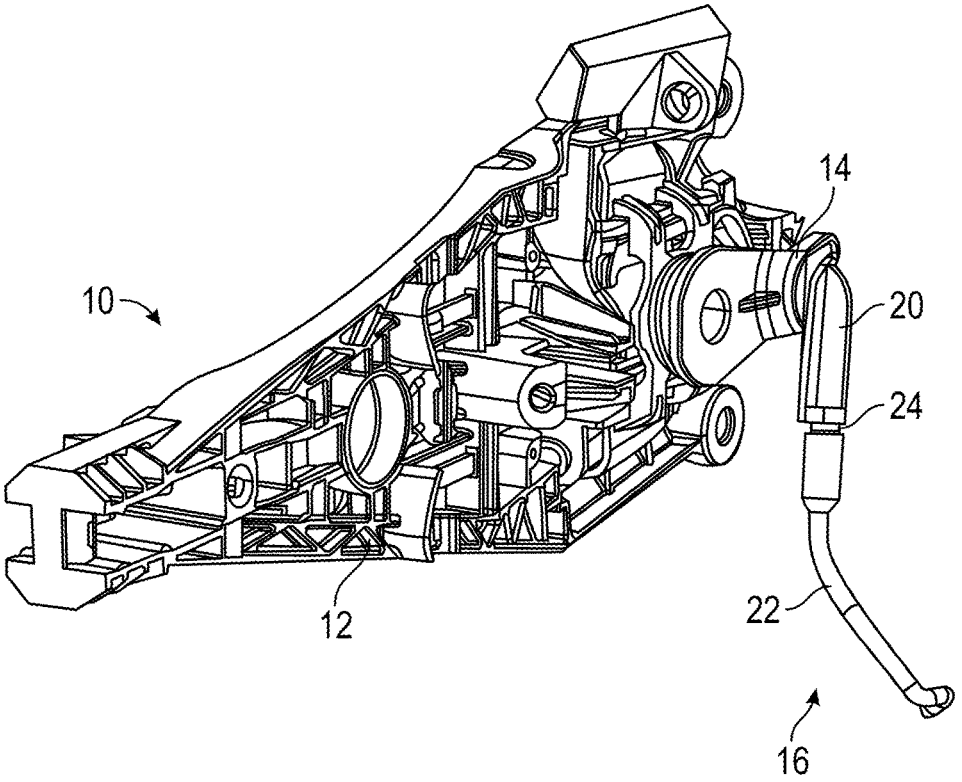
FIG. 1 is an isolated perspective representation of a handle module, seen from the vehicle inside.
Figure 2:
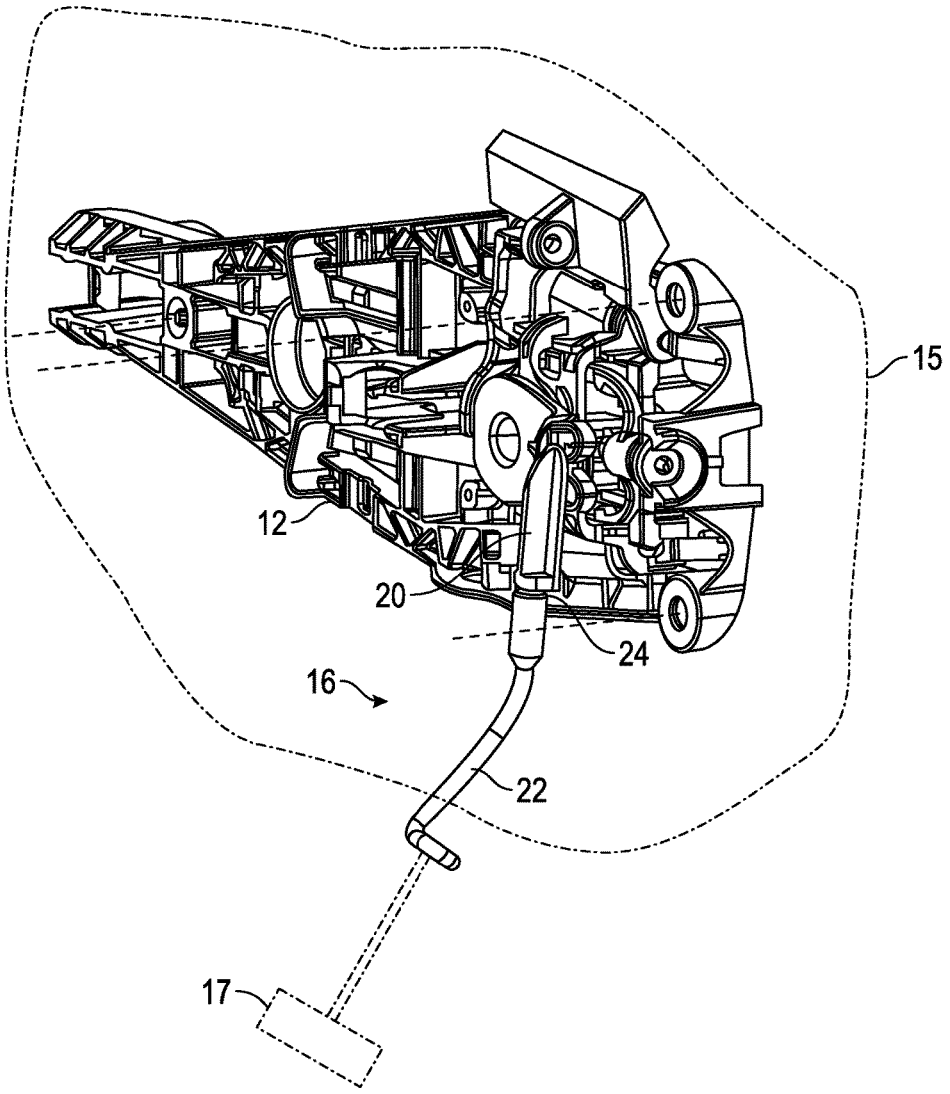
FIG. 2 is a further perspective representation of the handle module according to FIG. 1 from another perspective.

The following detailed description is merely exemplary in nature and is not intended to limit application and uses. Furthermore, there is no intention to be bound by any theory presented in the preceding background or summary or the following detailed description.

The handle module 10 shown in FIG. 1 to FIG. 4 in partially different perspective representations comprises a modular basic body 12 on which towards the door inside a pivotable giver 14 designed according to the type of a crank is arranged. The giver is moveable by means of an outer door handle 13 and arranged on the side of the modular basic body 12 located opposite the giver 14 and protruding through an outer door panel 15 of the vehicle door. For opening a door lock with a taker 17 it is for instance provided that the giver 14 designed in the manner of a crank with its free end moves upwards in the representation according to FIG. 1.

Upon a corresponding opening movement the actuation or lock rod 16 articulated thereon is likewise pulled upwards so that the actuation lever of the door lock, which is likewise preferentially in an operational connection in a pivotable manner with a lower end portion of the lock rod 16, is pulled upwards into its release position. The lock rod 16 in the present embodiment according to FIG. 1 to FIG. 5 is at least designed in two parts, and a connecting part 20 is located at the top is pivotably articulated on the giver 14. The connecting part 20 is additionally connected to a rod part 22 that in turn is in engagement with the not explicitly depicted actuation lever of the door lock. Between rod part 22 and connecting part, or in the transition region of connecting part 20 and rod part 22 a predetermined breaking point 24 or a weakening is provided, which ensures a defined breaking-apart of the actuation rod 16 as soon as for example during the course of a break-in attempt external forces act on the door structure.

Figure 4:
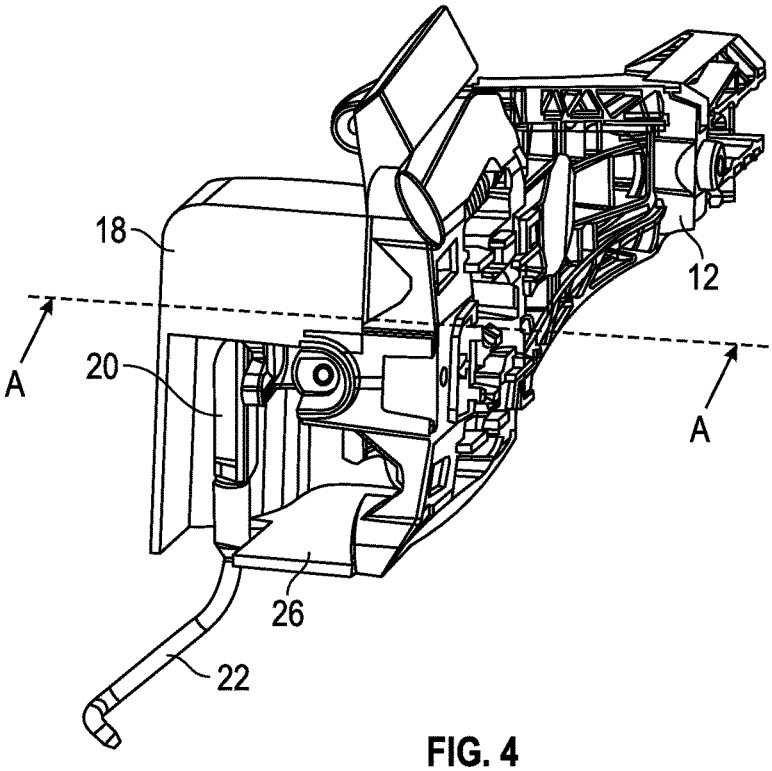
FIG. 4 is the handle module according to FIG. 3 seen from a face end.
Figure 5:
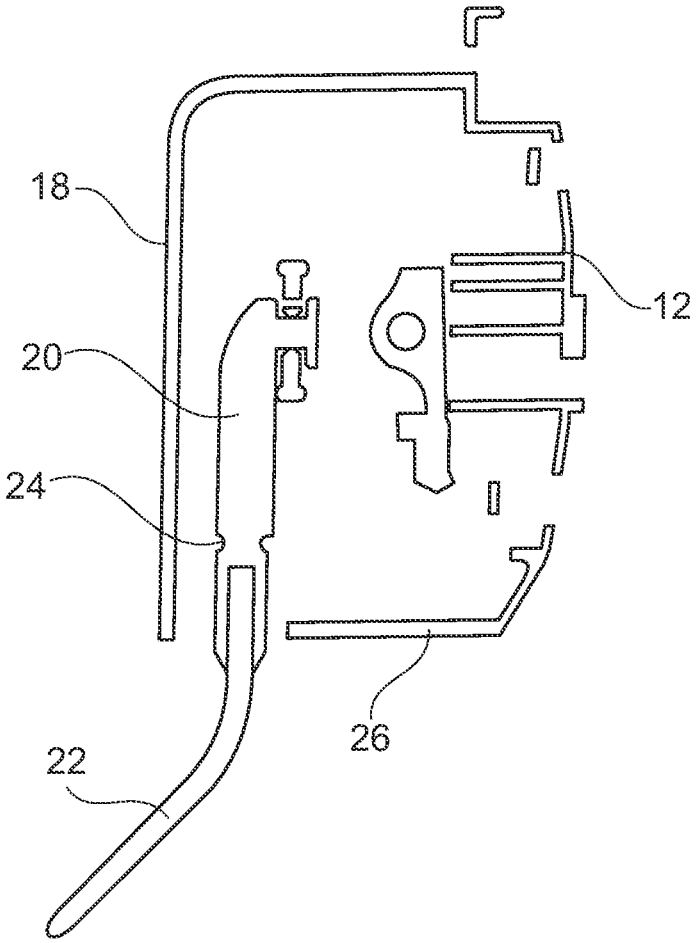
FIG. 5 is the handle module according to FIG. 4 along the section line A-A.

Such forces can preferentially be absorbed with a transmission element 26, as is shown in FIG. 4 and FIG. 5, by an outer door panel deforming as a result of the force effect and directly transmitted to the connecting part 20 and/or the rod part 22, which ultimately results in the breakage of the predetermined breaking point 24. As a consequence of this the lower rod part 22 due to the force of gravity will fold away downwards so that it can no longer be grasped with the help of conventional break-in means and opening of the door lock will consequently be no longer possible.

Figure 3:
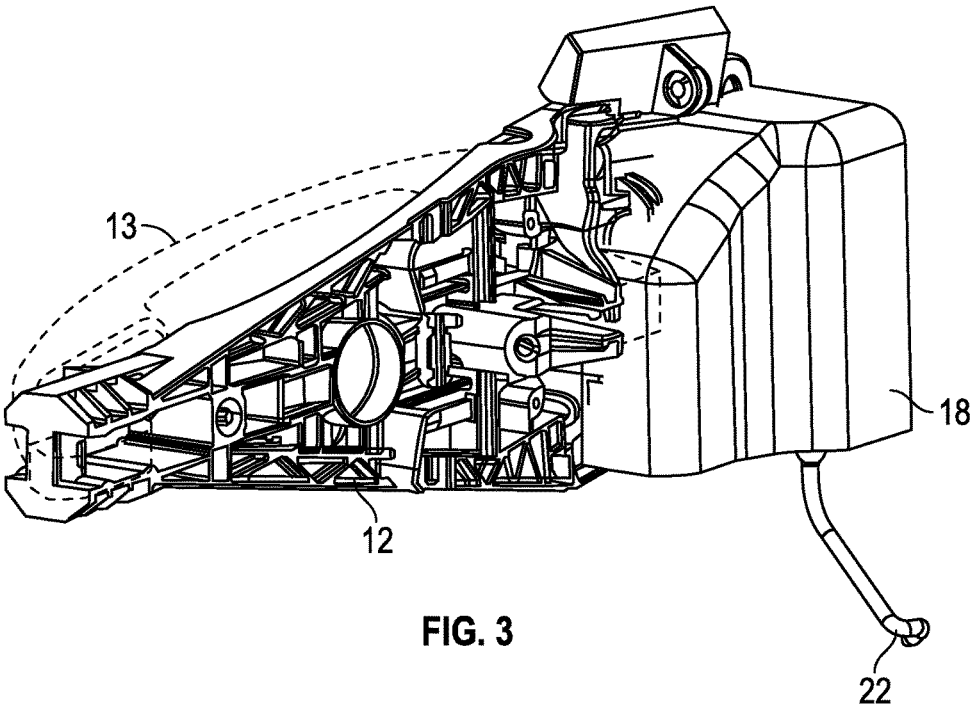
FIG. 3 is the handle module in the representation according to FIG. 1 with shielding device arranged thereon.

In addition a shielding device or cover 18 acting as cover is shown in FIG. 3, FIG. 4 and FIG. 5 that largely completely encloses the connecting region of giver 14 and actuation rod 16, rendering it inaccessible to possible break-in tools. Here, the cover 18 is preferentially unreleasably connected to the basic body 12 of the handle module 10 so that following reciprocal assembly, disassembly of the connecting part 20 and the cover 18 from the basic body 12 or from the giver 14 can no longer be effected in a non-destructive manner. Additionally, it proves an advantage if the connecting part 20 and the rod part 22 of the actuation rod 16 are only connected to each other during the course of a final assembly of the closing device on the motor vehicle door. Because of this it is made possible to fasten the connecting part 20 already preconfigured on the giver 14 and to arrange such a handle module 10 provided with a cover 18 as a whole on the door structure of the motor vehicle in a simple manner.

The connection of connecting part 20 and rod part 22 in this case can be preferentially effected via positive connection means for example via a bayonet-like closure mechanism which requires twisting of the rod part 22 relative to the connecting part 20 during the course of the final assembly. Turning back releasing the bayonet closure in this case is prevented for example through the fastening of door lock and handle module 10 to the door structure.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A handle module for the fastening of an outer door handle to a motor vehicle door, comprising:

a modular basic body having an outer door handle, said modular basic body being configured to be arranged on an inside of an outer door panel of a motor vehicle door with the outer door handle protruding through an opening of the outer door panel; the modular basic body including a planar transmission element secured to the modular basic body and extending towards an actuation rod to bring about a breakage of the actuation rod upon occurrence of an external force that deforms the motor vehicle door, the planar transmission element having an L-shaped cross section, wherein a first leg extends in a vehicle transverse direction towards the actuation rod and a second leg of the L-shaped configuration extends between the modular basic body and the outer door panel;

a giver mounted on the modular basic body and adapted for an operational connection with a taker of a door lock via the actuation rod; and a shielding device at least partially enclosing a region of the giver to protect and secure the giver against external manipulation, wherein the giver is pivotably mounted on the modular basic body and wherein the giver can be pivoted between a basic and an actuation position by actuating the outer door handle, wherein the actuation rod comprises a rod part, a connecting part articulated on the giver and a predetermined breaking point formed between the rod part and at least a portion of the connecting part.

2. The handle module according to claim 1, wherein the shielding device is fixed to the modular basic body.

3. The handle module according to claim 1, wherein the shielding device is unreleasably arranged on the modular basic body so that at least partial destruction of at least one of the shielding device and the modular basic body is required to disassemble the shielding device from the modular basic body.

4. The handle module according to claim 1, wherein the shielding device is a box-shaped cover and adapted to open towards a bottom and towards the door lock.

5. The handle module according to claim 1, wherein the shielding device is arranged on a side of the modular basic body facing away from the outer door handle.

6. The handle module according to claim 1, wherein the shielding device substantially extends over an entire height of the modular basic body and extends along a vehicle vertical axis.

7. The handle module according to claim 1, wherein the predetermined breaking point is formed in the connecting part.

8. A method for assembly of a closing device on a motor vehicle door, comprising:

providing a handle module comprising a modular basic body having an outer door handle; arranging the handle module on an inside of an outer door panel of a motor vehicle door with the outer door handle protruding through an opening of the outer door panel, the modular basic body including a planar transmission element secured to the handle module and extending towards an actuation rod to bring about a breakage of the actuation rod upon occurrence of an external force that deforms the motor vehicle door, wherein the planar transmission element has an L-shaped cross section with a first leg extending in a vehicle transverse direction towards the actuation rod and a second leg of the L-shaped configuration extending between the modular basic body and the outer door panel and wherein the actuation rod comprises a rod part and a connecting part;

mounting a giver on the modular basic body adapted for an operational connection with a taker of a door lock via the actuation rod;

preassembling the connecting part to the giver;

thereafter, at least partially enclosing a region of the giver with a shielding device to protect and secure the giver against external manipulation;

connecting the connecting part to the rod part in a second operational connection with the taker of the door lock; and fastening the handle module to a door structure.

9. The method according to claim 8, wherein the mounting the giver is pivotably mounting.

10. The method according to claim 8, wherein the mounting the giver is rotatably mounting.

11. The method according to claim 8, further comprising fixing the shielding device to the modular basic body.

12. The method according to claim 8, further comprising unreleasably arranging the shielding device on the modular basic body.

13. The handle module according to claim 1, wherein a connection of the connecting part and the rod part comprises the predetermined breaking point.

14. A handle module for the fastening of an outer door handle to a motor vehicle door, comprising:

a modular basic body having an outer door handle, said modular basic body being configured to be arranged on an inside of an outer door panel of a motor vehicle door with the outer door handle protruding through an opening of the outer door panel; the modular basic body including a planar transmission element secured to the modular basic body and extending towards an actuation rod to bring about a breakage of the actuation rod upon occurrence of an external force that deforms the motor vehicle door, the planar transmission element having an L-shaped cross section, wherein a first leg extends in a vehicle transverse direction towards the actuation rod and a second leg of the L-shaped configuration extends between the modular basic body and the outer door panel;

a giver mounted on the modular basic body and adapted for an operational connection with a taker of a door lock via the actuation rod; and a shielding device fixed to the modular basic body, the shielding device having a box-shape and extending over an entire height of the modular basic body and extending along a vehicle vertical axis to protect and secure the giver against external manipulation, wherein the giver is pivotably mounted on the modular basic body and wherein the giver can be pivoted between a basic and an actuation position by actuating the outer door handle, wherein the actuation rod comprises a rod part, a connecting part articulated on the giver, and a predetermined breaking point formed between the rod part and at least a portion of the connecting part such that the planar transmission element contacts and breaks the actuation rod at the predetermined breaking point when the door is subjected to an external force in the vehicle transverse direction.

* * * * *